US008851360B2

(12) United States Patent
Cenzano

(10) Patent No.: US 8,851,360 B2
(45) Date of Patent: Oct. 7, 2014

(54) ENVELOPE WITH INTEGRAL SEAL STRIP

(75) Inventor: Lauren Cenzano, N Babylon, NY (US)

(73) Assignee: Esselte Corporation, Melville, NY (US)

( * ) Notice: Subject to any disclaimer, the term of this patent is extended or adjusted under 35 U.S.C. 154(b) by 0 days.

(21) Appl. No.: 13/560,150

(22) Filed: Jul. 27, 2012

(65) Prior Publication Data

US 2013/0119121 A1 May 16, 2013

Related U.S. Application Data

(60) Provisional application No. 61/560,198, filed on Nov. 15, 2011.

(51) Int. Cl.

| | |
|---|---|
| ***B65D 27/30*** | (2006.01) |
| ***B65D 27/06*** | (2006.01) |
| ***B65D 27/04*** | (2006.01) |
| ***B65D 27/16*** | (2006.01) |
| ***B65D 27/28*** | (2006.01) |
| ***B65D 27/14*** | (2006.01) |

(52) U.S. Cl.

CPC ..... *B65D 27/16* (2013.01); *B65D 27/28* (2013.01); *B65D 27/14* (2013.01)

USPC ..... 229/79; 229/300; 229/71

(58) Field of Classification Search

USPC ..... 229/79, 80, 300, 301, 305, 306, 70, 71; 383/62

See application file for complete search history.

(56) References Cited

U.S. PATENT DOCUMENTS

| | | | | |
|---|---|---|---|---|
| 913,987 | A | 3/1909 | Simmons | |
| 2,088,232 | A | 7/1937 | Cumming | |
| 2,367,440 | A | 1/1945 | Schieman | |
| 3,702,171 | A | 11/1972 | Levine | |
| 4,008,851 | A | 2/1977 | Hirsch | |
| 5,052,613 | A * | 10/1991 | Lin | 229/303 |
| 5,429,576 | A | 7/1995 | Doderer-Winkler | |
| 6,155,481 | A * | 12/2000 | Rawlings | 229/300 |
| 6,488,999 | B1 * | 12/2002 | Flynn et al. | 428/42.2 |
| 2006/0231605 | A1 * | 10/2006 | Collins | 229/301 |
| 2010/0038414 | A1 * | 2/2010 | DeLaVergne | 229/305 |

* cited by examiner

*Primary Examiner* — Jes F Pascua

(74) *Attorney, Agent, or Firm* — Dorsey & Whitney LLP

(57) ABSTRACT

An envelope having an envelope wall member including first and second envelope walls that cooperatively enclose a pocket space and define therebetween a pocket opening to the pocket space, the envelope wall including a surface that defines a recess and a sealing strip that includes an adhesive releasably adhering the strip to the envelope wall member within the recess. The adhesive is capable of adhering the strip to the envelope wall to seal the envelope closed.

23 Claims, 5 Drawing Sheets

ENVELOPE WITH INTEGRAL SEAL STRIP

CROSS-REFERENCE TO RELATED APPLICATIONS

This application claims priority to U.S. Provisional Application No. 61/560,198 filed Nov. 15, 2011. The entire disclosure of the above-referenced application is incorporated herein by reference in its entirety.

TECHNICAL FIELD

The present disclosure generally relates to a sealing strip used with an envelope. More particularly, the present disclosure relates to a sealing strip incorporated into one wall of an envelope.

BACKGROUND

Known envelope flaps often have a moisture activated adhesive or a removable barrier over the adhesive (so called peal and stick), or any other included adhesive. Prior to the traditional adhesive strip, flaps were sealed with an external binding connected to both the flap and adjacent side to bind the flap closed. This binding could be melted wax or the like. An affixable seal (e.g. a foil piece with adhesive included on one side), and/or a sticker type item has also been used to seal (or double seal in conjunction with included flap adhesive) envelope flaps. U.S. Pat. No. 2,367,440 describes a self-sealing paper envelope. Also, U.S. Pat. No. 5,429,576 describes a reusable adhesive envelope having a pressure sensitive adhesive, which is initially covered by a release liner. Upon removing the release liner the adhesive on the flap may be secured to the protective strip to close the flap, which may be opened and closed numerous times.

Users of envelopes will sometimes double seal an envelope to ensure it does not open during transit, or otherwise increase the effectiveness of the closure seal. A deficiency of the most common included adhesive, i.e., moisture activated adhesives, is that a heavy humidity, heat, or other environmental condition can weaken or even release the closure seal, thereby opening the envelope during transit. To strengthen the seal, a user may apply some tape or a sticker across the flap and adjacent side in order to deter this deficiency of just the flap adhesive alone. U.S. Pat. No. 913,987 describes an envelope where projecting tongues are adapted to fold over the sealing flap after the latter is folded and sealed, and thus firmly secure the sealing flap and prevents it from being opened. U.S. Pat. No. 3,702,171 describes an envelope with superimposed strips aligned to be partially lifted and placed back down on the flap to seal the envelope. A problem with these known envelopes is that they can add complexity to the manufacturing process. Additionally, as the releasable adhesive layer is placed on a wall of the envelope after the envelope has been manufactured, the releasable adhesive can add a non-uniform thickness to the envelope, making it difficult to store multiple envelopes on top of each other.

Thus, is may be desirable to provide an envelope having a removable adhesive strip for additional sealing of the envelope that can be integrated into one of the walls of the envelope. It is further desirable to provide an envelope that can be easy to manufacture, and that can be made from a continuous sheet of material.

SUMMARY

An envelope having an envelope wall member including first and second envelope walls that cooperatively enclose a pocket space and define therebetween a pocket opening to the pocket space, the envelope wall including a surface that defines a recess and a sealing strip that includes an adhesive releasably adhering the strip to the envelope wall member within the recess. The adhesive is capable of adhering the strip to the envelope wall member in a different location than the recess to seal the envelope closed, such as by sealing the pocket opening closed.

In some embodiments, the recess is defined on an outer surface of the envelope wall member. In some embodiments, the envelope wall member includes the sealing strip. In some embodiments, the envelope wall member includes a separation line, such as a cut line or a weakened region outlining or otherwise-delineating the sealing strip to enable the sealing strip to be separated from a remainder of the envelope wall member. Where a weakened region is used, the strip can be separated by breaking the weakened region, the weakened region defining the recess. In some embodiments, the weakened region includes a line of perforations. Some embodiments can have a cut line extending around the strip, separating the strip from the wall member and defining the recess. In some embodiments, the sealing strip is substantially coplanar with the envelope.

In some embodiments, the strip and recess are substantially the same size and shape. In some embodiments, a release layer is disposed in the recess, the release layer providing releasable adhesion of the sealing strip to the envelope wall member and allowing removal of the sealing strip therefrom. In some embodiments, the release layer extends over substantially the entire recess. In some embodiments, the envelope wall member includes inner and outer layers and the recess includes an opening extending completely through the outer layer such that the sealing strip is releasably adhered to the inner layer. In some embodiments, a release layer is disposed on the inner layer and is aligned with and facing the recess, the release layer providing releasable adhesion of the sealing strip to the envelope wall member and allowing removal of the sealing strip therefrom.

In some embodiments, the release layer extends over substantially the entire opening in the outer layer. In some embodiments, the inner and outer layers are adhered adjacent to and around the perimeter of the recess. In some embodiments, the envelope wall member is made of a single sheet of material that is folded and adhered to provide the first and second walls, including the inner, and outer layers of the second wall. In some embodiments, the envelope wall member includes a closure flap pivotally attached to the first or second wall, wherein in the closed position, the flap closes the pocket opening and is sealable to the other of the first or second walls with the sealing strip. In some embodiments, the flap extends from the first wall adjacent the pocket opening. In some embodiments, the sealing strip can be moved from a first location to a second location to seal the envelope. In some embodiments, the recess is defined on the second wall.

In an embodiment of a method of making an envelope according to the disclosure, a first sheet layer is affixed to a second sheet layer to provide the second envelope wall. The outer layer can include an adhesive, and the inner layer can include a release material in contact with and releasably adhered to the adhesive. The first and second envelope walls can be affixed together to cooperatively enclose a pocket space and define therebetween a pocket opening to the pocket space. The outer layer can be cut to provide a sealing strip separable therefrom and that includes the adhesive, so that the sealing strip is releasably adhered to the release material. The adhesive is preferably capable of adhering the strip to at least one of the envelope walls in a different location than the release material the recess to seal the pocket opening closed. In an embodiment, a sheet blank can be folded and adhered to provide the first wall, the inner and outer layers of the second wall, and a flap pivotable for closing the opening, and the adhesive can be selected to adhere the strip to the flap and one of the envelope walls to retain the flap closed.

Additional advantages and novel features of the examples will be set forth in part in the description which follows, and in part will become apparent to those skilled in the art upon examination of the following description and the accompanying drawings or may be learned by production or operation of the examples. The advantages of the concepts may be realized and attained by means of the methodologies, instrumentalities and combinations particularly pointed out in the appended claims.

BRIEF DESCRIPTION OF DRAWINGS

While the specification concludes with claims particularly pointing out and distinctly claiming the subject matter that is regarded as forming the present invention, it is believed that the disclosure will be better understood from the following description taken in conjunction with the accompanying Figures, in which:

DETAILED DESCRIPTION

Figure 1:
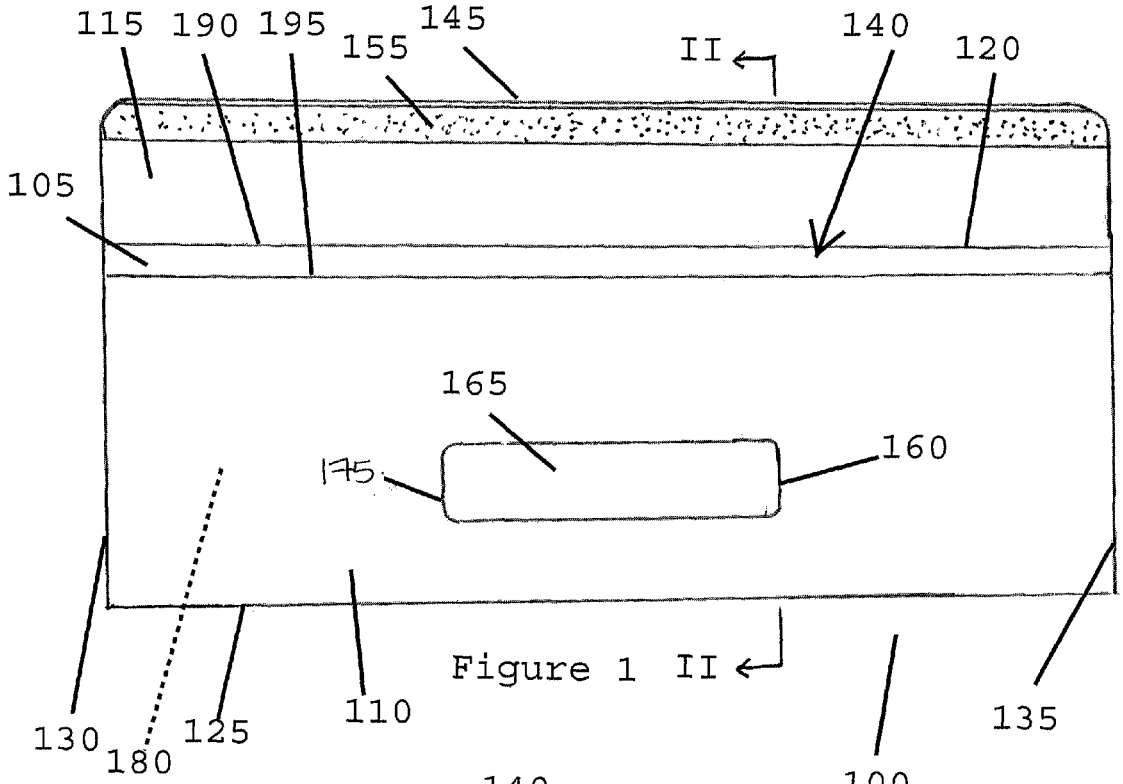
FIG. 1 is a rear view of an envelope with a removable sealing strip, according to an exemplary embodiment of the present invention.
Figure 2:
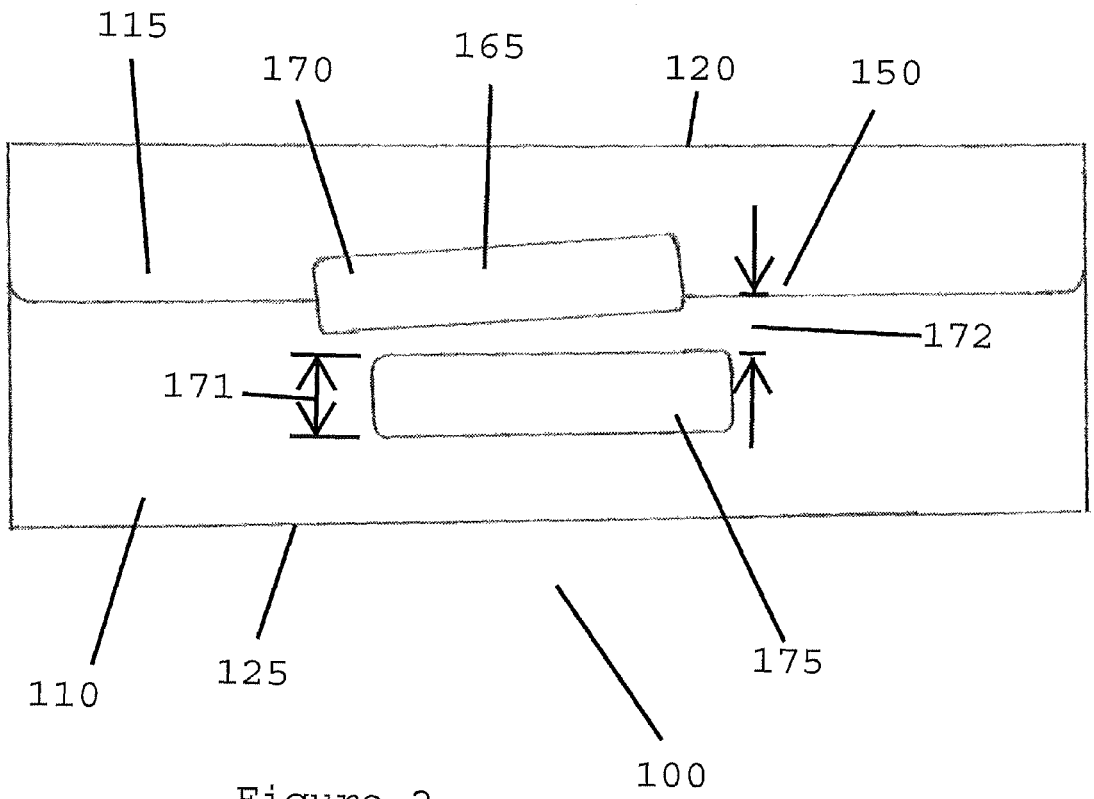
FIG. 2 is a rear view of the envelope according to FIG. 1, with the closure flap illustrated in the closed position.

Referring to FIGS. 1 and 2, an exemplary embodiment of the present disclosure can include an envelope 100. Envelope 100 can be a standard sized envelope designed to fit an 8½" by 11" standard sheet of paper in the folded position. For example, envelope 100 can be approximately 9¾" by 4⅛" when the sealing flap is in the closed position. Alternatively, envelope 100 can be of any standard sizes or shapes configured to receive one ore more standard sized papers (e.g., letter, A4 etc.). For example, envelope 100 can be #00, #1, #2, #3, #4, #5, #6, #7 or a number #8 envelope. For example, exemplary envelopes can be of any standards sizes configured to receive one or more standard sized papers, e.g., letter, legal, A4, etc. Additionally, exemplary envelopes can have a commercial flap, a square flap, a wallet flap, a side seam, and envelope 100 can be a policy envelope, a booklet envelope, a catalog envelope, a square envelope, a baronial envelope, or an announcement envelope. Furthermore, envelope 100 can be made of any suitable material for making envelopes can have an address window or envelope 100 can be windowless.

Envelope 100 can be formed from a blank that is folded and glued or otherwise affixed along certain edges (e.g., two or three out of four edges in a rectangular envelope). The blank can be die cut from a single sheet, and have at least two walls that define an inner pocket therebetween. For example, envelope 100 can include a front wall 105, which is substantially hidden in FIG. 1 and which has a top 190. Additionally, envelope 100 can have a rear wall 110 which has a top 195 which can be at or lower than top 190 of front wall 105. Front wall 105 can be connected to a sealing flap 115 via hinge 120. Hinge 120 can be a living hinge, and/or a fold of a continuous structure that forms both sealing flap 115 and front wall 105. For example hinge 120 can be formed by scoring the material used to form envelope 100. Similarly, rear wall 110 can be a continuous structure with front wall 105, via a hinge along bottom edge 125, while side edges 130 and 135 can be affixed together, e.g. via a permanent adhesive. Rear wall 110 can be a privacy wall such that it can prevent viewing of the contents inside of the envelope. The privacy portion can be formed by adding markings in a different color than the envelope, such as black, which can prevent the viewing of the contents of the envelope. Additional methods of creating a privacy wall can be used.

Front and second walls 105 and 110, along with sealed edges 125, 130, and 135 can define a pocket 180 and pocket opening 140. It should be noted that an alternative embodiment of an envelope need not have sealing flap 115, and front wall 105 and rear wall 110 can form an opening at the top of envelope 100 without a sealing flap 115.

Sealing flap 115 can be smaller than front wall 105 and rear wall 110, and can include a free edge 145 that defines a borderline between the flap and an adjacent portion of the rear wall 110 when in the closed position. The sealing flap 115 can pivot (e.g., about 180° from alignment extending from the front wall 105 to the closed position via hinge 120), into contact with an overlap area 150 (shown in FIG. 2) of the rear wall 110. Once pivoted, the sealing flap 115 closes the opening (as shown in FIG. 2). The closure flap 115 can include an adhesive layer 155, such as a moisture activated glue strip, or an adhesive with a removable cover strip such that it can remain tacky until it is pressure activated, or other suitable adhesive arrangement. It should be noted that the above variation is for exemplary purposes only, and other variations and exemplary envelopes can be used.

The envelope 100 can include a first location 160 with a sealing strip 165 temporarily or removably adhered thereto. The first location 160 can be located outside of the area of overlap 150 in a position different than necessary to seal the flap 115 to the rear wall 110. Preferably, the sealing strip 165, in the first location 160, is positioned such that it needs to be completely removed from the envelope 100 and then repositioned over the flap 115 and rear wall 110 in a second location to seal the flap 115 in the closed position. In the embodiment shown, the first location 160 is located on the rear wall 110. However, it should be noted that the first location 160 can be located on the front wall 105 or on the sealing flap 115.

The sealing strip 165 can be removable from the first location 160. Sealing strip 165 can be detachable from the portion of the envelope to which it is removably attached to in the first location and placeable in a second location 170 (as shown in FIG. 2), which can overlap the closure flap 115 in the closed position and an adjacent portion of the rear wall 110. The second location 170 is illustrated in approximately the center of the overlap area 150 border, although alternatively the user can select another suitable placement for the second location 170 such that it provides a second seal for envelope 100. The second location 170 can include any suitable area, size, or orientation that overlaps the closure flap 115 in the closed position and an adjacent portion of the rear wall 110.

In the example above with envelope 100 not having a sealing flap 115, sealing strip 165 can be designed to close the inner pocket and maintain it closed. To close the inner pocket, the sealing strip 165 is placed such that it is attached to a portion of front wall 105 and rear wall 110 and extends across the pocket opening 140.

Additionally, sealing strip 165 can be of any suitable size and shape for keeping the envelope sealed during handling and/or mailing of envelope 100. For example, sealing strip 165 can be approximately 3¼" long and ¾" wide shown by element number 171, although not limited thereto. As shown in FIG. 1, sealing strip is substantially rectangular and is sized to be smaller than rear wall 110 in both length and width, although sealing strip 165 can be circular, oval or star-shaped, although not limited thereto. Alternatively, sealing strip can be any length such as substantially the same length and width as that of rear wall 110, although not limited thereto. For example, sealing strip 165 can be as small as 10%, 20%, 30% or 40% of the length of envelope 100 and as large as 60%, 70%, 80%, 90% or 100% of the length of envelope 100, although not limited thereto. Additionally, the width of sealing strip 165 can be as small as 10%, 20%, 30% or 40% of the width of envelope 100 or as large as 60%, 70%, 80% or 90% of the width of envelope 100, although not limited thereto. Sealing strip 165 can substantially close the inner pocket formed by front wall 105 and rear wall 110, such as when there is no sealing flap 115, and sealing strip can be approximately the same length as rear wall 110 for such application.

Sealing strip 165 can be spaced apart from flap 115 when flap 115 is in the closed position by approximately 1". Alternatively, the distance 172 between sealing strip 165 and flap 115, when flap 115 is in the closed position, is approximately ¼, ½ the width of sealing strip 165 or the distance can be at least the height of sealing strip 165.

Sealing strip 165 can be formed from rear wall 110 itself, for example such that the sealing strip 165 is substantially coplanar and/or contiguous with rear wall 110. For example, sealing strip 165 can be separated from rear wall 100 by being completely cutout of rear wall 110 or by a weakened region, although not completely passing through the entire thickness of rear wall 110 as seen in more detail below. Sealing strip 165 can be similarly sized to a cutout 175 in rear wall 110 (as shown in FIG. 2) resulting in sealing strip 165 and cutout 175 substantially touching each other when sealing strip 165 is located in cutout 175. Cutout 175 can be also be a recess in rear wall 110 that sealing strip 165 substantially fits into or substantially covers the entirety of. In a preferred embodiment, cutout 175 is located on the outer wall of envelope 100 not covered by flap 115 when flap 115 is in the closed position.

In embodiments in which the sealing strip 165 is formed from a layer of the envelope wall itself, a separation line can be provided to delineate the sealing strip, providing, for example, a small space or slit between cutout 175 and sealing strip 165. This can facilitate easier removal of sealing strip 165 from cutout 175. Sealing strip 165 can be formed by any suitable method including by making a continuous, closed cut or intermittent cuts to provide a line of perforations. For example, sealing strip 165 can be formed by kiss cutting through the outer layer, and preferably not the inner layer. Furthermore, sealing strip 165 can be formed prior to the attachment of the inner layer and the outer layer detailed below, or sealing strip 165 can be formed after rear wall 100 has been formed by cutting through a partial thickness of rear wall 110. In alternative embodiments, the sealing strip can be placed in a preexisting recess or opening in the outer layer so that it is submerged in the recess thereof and releasably adhered to the release layer described below.

The sealing strip 165 can include any suitable adhesive capable of adhering to the closure flap 115 and the adjacent portion of the rear wall 110 for securing the closure flap 115 in the closed position. The adhesive can cause a removable bond with surface material at the first location 160 by remaining tacky until the adhesive is pressure activate. The adhesive can then form an effectively permanent bond with the second location 170 that can be stronger than the paper it is attached to such that a removal of the sealing strip 165 can rip the paper or the sealing strip 165. Alternatively, the adhesive can create a semi-permanent bond with the second location 170, which bond is significantly stronger than with the surface at the first location 160 but can still be removable from second location 170. This can be accomplished in any number of ways. For example, first location 160 can include a surface structure or material that causes the adhesive to form a tacky bond, while still being removable, while the second location 170 can include a surface structure or material that causes the same adhesive to form a more permanent bond. The second location 170 can be a paper-based material, or any other suitable material. The first location 160 can include a different material affixed to the envelope 100 surface, which can include a release layer of a release material, which can be applied, for example, as a laminated layer, sprayed-on layer, or by another suitable process. Alternatively, the release layer can be part of, and integrated into, rear wall 110. The release layer can be provided, for example, with a tape having a non-stick or semi-stick surface, wax paper, sprayed on wax or other release layer, plastic, or other suitable materials.

Figure 3:
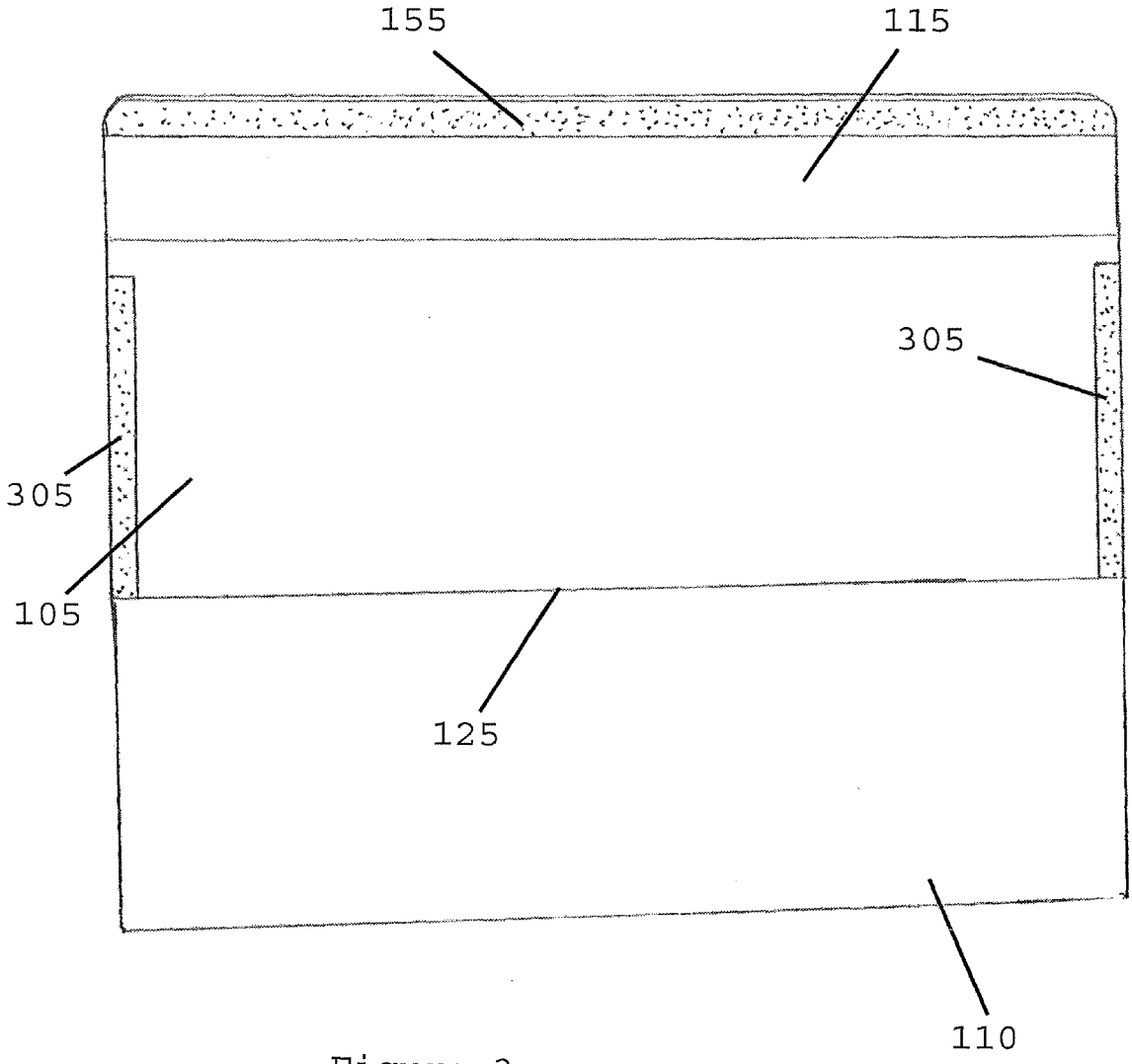
FIG. 3 is a view of a partially assembled envelope of FIG. 1.

Referring to FIG. 3, a partially unfolded view of the envelope 100 according to FIG. 1 is shown. Front wall 105 and rear wall 110 can be formed by a continuous and unitary sheet of material such as paper. To form the inner pocket between front wall 105 and rear wall 110, a hinge 125 can be created to form front wall 105 and rear wall 110. Rear wall 110 can be folded over front wall 105, using hinge 125, and can be adhered to front wall 105 using adhesive 305 to form a single wall at the edges of envelope 100. Adhesive 305 can be continuous strips of adhesive formed on side edges 130 and 135. Alternatively, adhesive 305 can be formed from non-continuous adhesive portions along side edges 130 and 135.

Front wall 105 can be approximately 4⅛" wide and 9¾" in length, not including sealing flap 115, although not limited thereto. Sealing flap 115 can be approximately 1½" wide, although not limited thereto. Thus, the combination of front wall 105 and sealing flap 115 can be approximately 5⅝" inches wide, although not limited thereto.

Figure 4:
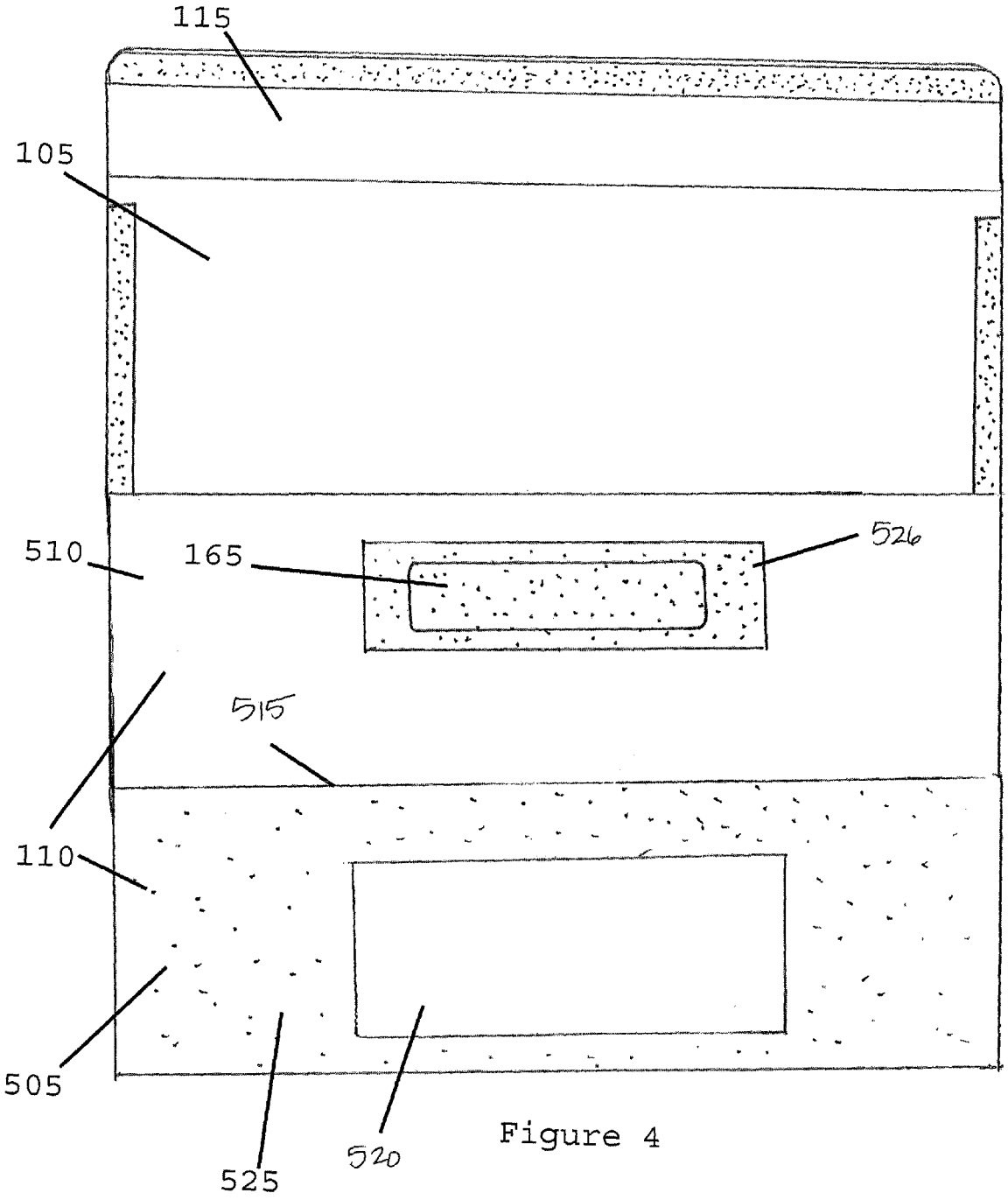
FIG. 4 is a view of a blank used to make the envelope of FIG. 1.

Referring to FIG. 4, an unfolded view of the envelope 100 according to FIG. 1 is shown. Rear wall 110 can be formed from a inner layer 505 and a outer layer 510. Inner layer 505 can be substantially the same size as outer layer 510 or inner layer 505 can be smaller than outer layer 510. For example, both inner layer 505 and outer layer 510 can be approximately 9¾" long and 3½" wide, although not limited thereto. Inner layer 505 can extend from, and be formed from a contiguous or single sheet of material with that of outer layer 510.

To form rear wall 110, inner layer 505 can be folded over outer layer 510 using hinge 515. An adhesive layer 525 can be applied to front layer prior to inner layer 505 being folded over outer layer 510. Adhesive layer 526 can also be applied to outer layer 510. Adhesive layer 526 can be substantially the same size as, and/or extensively cover, outer layer 510 or adhesive layer 526 can be smaller in size than outer layer 510. For example, adhesive 526 can cover the outer edges of inner layer 505 and outer layer 510 as well as an area inclusive of and surrounding sealing strip 165 such that the combination of inner layer 505 and outer layer 510 appears and feels like a single wall.

Inner layer 505 can include a non-adhesive or release layer portion 520 located in approximately the same location as sealing strip 165 when inner layer 505 is folded over outer layer 510. Release layer 520 can be substantially the same size as sealing strip 165 or can be bigger than sealing strip 165. To form release layer 520, a non-stick material can be sprayed onto inner layer 505. Alternatively, an additional layer of material can be added onto rear wall 110 as a release layer.

Inner layer 505 can be folded over outer layer 510 to form rear wall 110 using adhesive 525. Rear wall 110 can then be folded over front wall 105 in the same direction to form envelope 100 using adhesive 305. As the release layer 520 corresponds to the approximate location of sealing strip 165, sealing strip 165 can be removed from rear wall 510 to provide a first seal or an additional seal to envelope 100.

Alternatively, adhesive layer 525 can be applied to inner layer 505 in a similar manner above but on the opposite side of envelope 100. Additionally, release layer 520 can be located on outer layer 510 with sealing strip 165 being located on inner layer 505. Inner layer 505 can be folded over outer layer 510, in a first direction, to form rear wall 110. Then rear wall 110 can be folded over front wall 105 in the opposite direction to form envelope 100.

Figure 5:
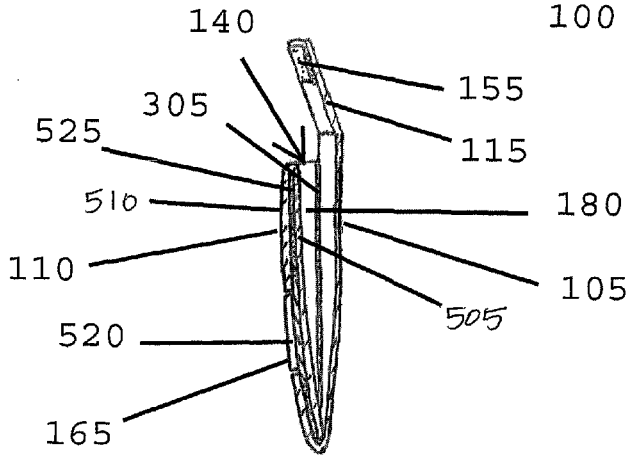
FIG. 5 is a side, cross-sectional view of the envelope of FIG. 1 taken along line II-II.

Referring to FIG. 5, sealing strip 165 is part of, and is substantially coplanar with, outer layer 510. Inner layer 505 has a release layer 520 which corresponds to the approximate location of sealing strip 165. Outer layer 510 is folded over inner layer 505 to form rear wall 110 using adhesive 525, and second wall 110 is folded over front wall 105 to form pocket 140 and envelope 100 using adhesive 305.

Figure 6:
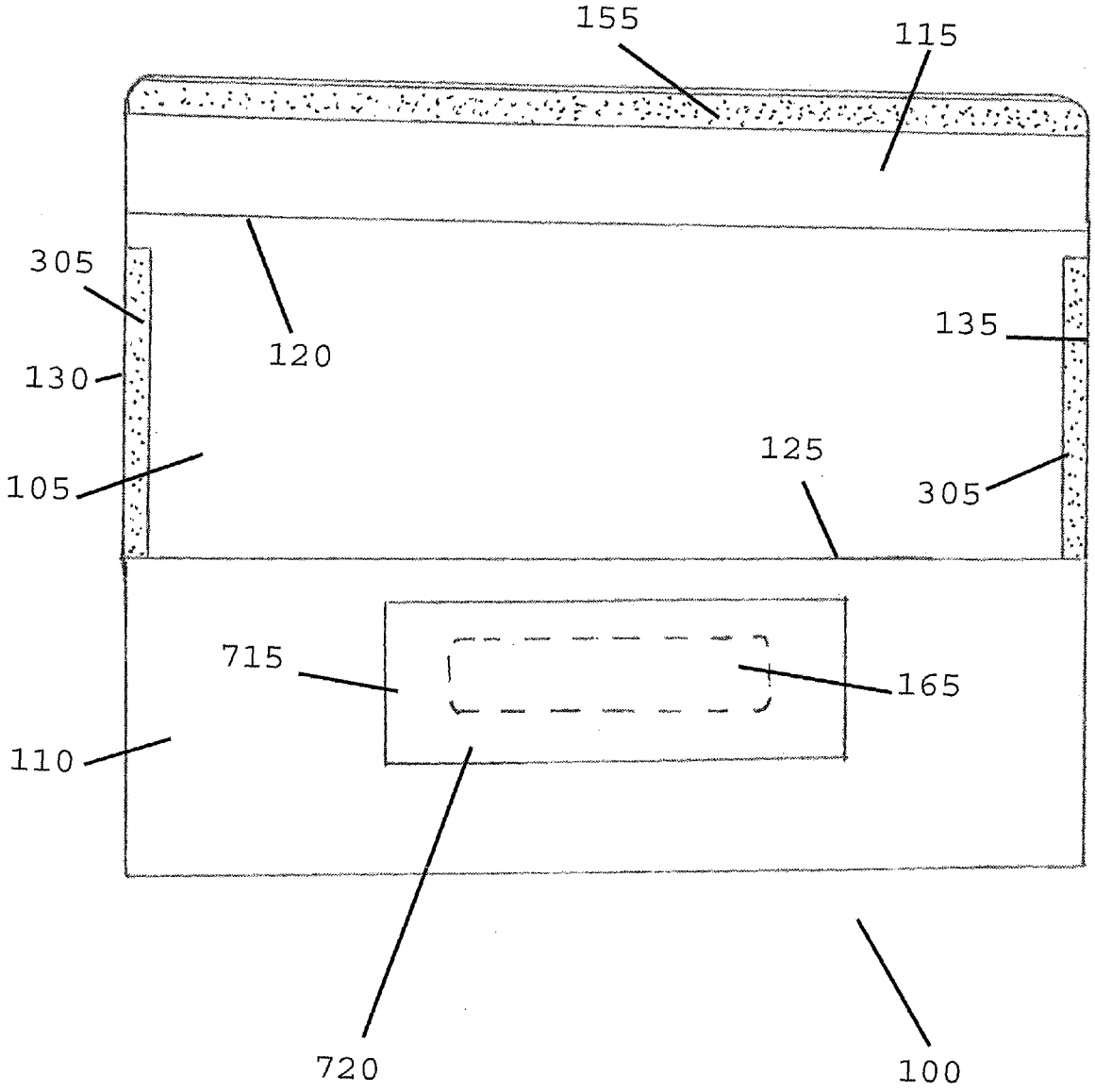
FIG. 6 is a view of a another embodiment of a partially assembled envelope.

Referring to FIG. 6, an unfolded view of an envelope having a rear layer 720 detached from a front layer 715, according to an exemplary embodiment of the present invention, is shown. In the exemplary embodiment above, envelope 100 is formed from a single, continuous sheet of material that is preferably unitary by folding inner layer 505 over outer layer 510 to form rear wall 110, and then folding rear wall 110 over front wall 105 to form envelope 100. In an alternative embodiment, front layer 715 is formed from separate, sheets of material with that of rear layer 720.

Outer layer 510 can be formed from the same continuous, preferably unitary sheet of material with front wall 105. To form rear wall 110, front layer 715 is adhered to rear layer 720 using an adhesive attaching lateral edges of the front and back walls. In this manner, the side edges 130 and 135 and bottom edge 125 of the envelope pocket can be closed, leaving the walls 105 and 110 separable and preferably unattached at the pocket opening 140 Front layer 715 can be substantially the same size as rear layer 720 or front layer 715 can be smaller than rear layer 720. If front layer 715 is sized smaller than rear layer 720, the adhesive used to form rear wall 110 is sized substantially the same size or smaller than front layer 715. This way, when rear wall 110 is folded over front wall 705 to form envelope 100, there is no extra adhesive to interfere with the placement of an object inside of envelope 100. In both alternatives above, rear layer 720 has a release layer located in approximately the same place as sealing strip 165 such that sealing strip 165 can be removed to provide a first seal or an additional seal to envelope 100.

All of the references specifically identified in the detailed description section of the present application are expressly incorporated herein in their entirety by reference thereto. The terms "approximately" and "about," as used herein, should generally be understood to refer to both the corresponding number and a range of numbers. Moreover, all numerical ranges herein should be understood to include each whole integer within the range. Moreover, various adhesives and/or bonds are described as temporary and/or permanent. These can relate to a general relative strength between the two, whether the bond would cause structural damage if removed, whether the adhesive can be reused after a previous use, or any number of other relative strength distinctions between permanent, semi-permanent, temporary, and/or removable. In the case of paper envelopes, a permanent adhesion would typically remove a layer of paper along with the strip as it is pulled off. References to more permanent adhesion indicates a noticeably stronger adhesion that a temporary adhesion.

As used herein, the terms "front," "back," "upper," "lower," "side" and/or other terms indicative of direction are used herein for convenience and to depict relational positions and/or directions between the parts of the embodiments. It will be appreciated that certain embodiments, or portions thereof, can also be oriented in other positions. In addition, the term "about" should generally be understood to refer to both the corresponding number and a range of numbers. In addition, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. An envelope, comprising:

an envelope wall member including first and second envelope walls connected at an envelope hinge, the first and second envelope walls cooperatively enclose a pocket space and define therebetween a pocket opening to the pocket space, the second envelope wall including a first layer and a second layer connected at a second wall hinge, wherein the first layer includes an adhesive portion and a release portion and the second layer includes a surface that defines a recess which aligns with the release portion in response to the first layer being folded against the second layer by bending at the second wall hinge; and a sealing strip that includes an adhesive releasably adhering the strip to the release portion located within the recess, the adhesive being capable of adhering the strip to the envelope wall member in a different location than the recess to seal the pocket opening closed.

2. The envelope of claim 1, wherein the recess is defined on an outer surface of the envelope wall member and the first envelope wall is connected to the second layer at the envelope hinge.

3. The envelope of claim 1, wherein the second layer of the envelope wall member includes the sealing strip.

4. The envelope of claim 3, wherein the second layer of the envelope wall member includes a weakened region outlining the sealing strip to enable the sealing strip to be separated from a remainder of the envelope wall member by breaking the weakened region, the weakened region defining the recess.

5. The envelope of claim 4, wherein the weakened region includes a line of perforations.

6. The envelope of claim 3, wherein the second layer of the envelope wall includes a layer of material defining a cut line extending around the strip, separating the strip from the wall member and defining the recess.

7. The envelope of claim 1, wherein the sealing strip is substantially coplanar with the envelope.

8. The envelope of claim 1, wherein the strip and recess are substantially the same size and shape.

9. The envelope of claim 1, wherein the release layer extends over substantially the entire recess.

10. The envelope of claim 1, wherein:

the recess includes an opening extending completely through the second layer, such that the sealing strip is releasably adhered to the first layer.

11. The envelope of claim 10, wherein the release layer extends over substantially the entire opening in the outer layer.

12. The envelope of claim 10, wherein the first and second layers are adhered adjacent to and around the perimeter of the recess.

13. The envelope of claim 10, wherein the envelope wall member is made of a single sheet of material that is folded and adhered to provide the first and second walls, including the first and second layers of the second wall.

14. The envelope of claim 1, wherein the envelope wall member includes a closure flap pivotally attached to the first or second wall, wherein the flap has a closed position in which the flap closes the pocket opening and is sealable to the other of the first or second walls with the sealing strip.

15. The envelope of claim 14, wherein the flap extends from the first wall adjacent the pocket opening.

16. An envelope, comprising:

a first envelope wall; and second envelope wall that cooperates with the first envelope wall to enclose a pocket space and define a pocket opening to the pocket space, the second envelope wall comprising inner and outer layers affixed to each other, wherein the outer layer defines a wall opening over a portion of the inner wall layer, the inner and outer layers connected at a second wall hinge, with the inner wall having an adhesive portion and a release portion, wherein the wall opening aligns with the release portion in response to the inner layer being folded against the outer layer by bending at the second wall hinge; and a sealing strip disposed within the wall opening and including an adhesive that releasably adheres the strip to the release portion when the outer layer is folded against the inner layer, the adhesive being capable of adhering the strip to at least one of the envelope walls in a different location than the wall opening to seal the pocket opening closed.

17. The envelope of claim 16, wherein the sealing strip is formed from the outer layer, the outer layer including a separation line delineating the sealing strip to enable separation thereof from the remainder of the outer layer.

18. The envelope of claim 17, wherein the separation line includes cut.

19. The envelope of claim 16, wherein:

the envelope wall member includes a closure flap pivotally attached to the first or second wall, the flap having a closed position in which the flap closes the pocket opening; and the sealing strip being adhereable over the flap and the other of the first or second walls with the sealing strip to retain the flap in the closed position.

20. The envelope of claim 19, wherein the flap extends and is pivoted from the first wall adjacent the pocket opening.

21. The envelope of claim 16, wherein the envelope is made from a single sheet of material folded and adhered to provide the first wall and the second wall inner and outer layers.

22. A method for making an envelope with first and second envelope walls, comprising:

folding a first sheet layer to a second sheet layer with the first and second sheet layers connected at a common hinge to form the second envelope wall, the first sheet layer including an adhesive, and the second sheet layer including a release material and an adhesive portion, each of which are in contact with the first sheet layer, the release material being in contact and releasably adhered to the adhesive and the adhesive portion being fixed to the first sheet layer;

affixing the first and second envelope walls together by folding the first and second envelope walls together at a common hinge to cooperatively enclose a pocket space and define therebetween a pocket opening to the pocket space; and cutting the first sheet layer to provide a sealing strip separable therefrom and that includes the adhesive, the sealing strip releasably adhered to the release material, with the sealing strip and the release material being aligned by folding the first and second envelope walls together at the common hinge, the adhesive being capable of adhering the strip to at least one of the envelope walls in a different location than the release material in the recess to seal the pocket opening closed.

23. The method of claim 22, further comprising forming the envelope from a sheet blank which provides the first wall, the first sheet and second sheet layers of the second wall, and a flap pivotable for closing the opening, wherein the adhesive is capable of adhering the strip to the flap and one of the envelope walls to retain the flap closed.

* * * * *